US006672008B1

(12) United States Patent
Luetzow et al.

(10) Patent No.: US 6,672,008 B1
(45) Date of Patent: Jan. 6, 2004

(54) GATE RELEASE MECHANISM HAVING A PIVOTABLE ARM TO FACILITATE MAINTENANCE

(75) Inventors: Edwin J. Luetzow, Brookings, SD (US); Richard L. Luetzow, Brookings, SD (US)

(73) Assignee: MTR, Inc., Brookings, SD (US)

( * ) Notice: Subject to any disclaimer, the term of this patent is extended or adjusted under 35 U.S.C. 154(b) by 0 days.

(21) Appl. No.: 09/899,457

(22) Filed: Jul. 5, 2001

Related U.S. Application Data

(63) Continuation-in-part of application No. 09/764,802, filed on Jan. 17, 2001, now Pat. No. 6,470,626.

(51) Int. Cl.[7] ..... E01F 13/08
(52) U.S. Cl. ..... 49/9; 49/49; 404/10
(58) Field of Search ..... 49/49, 9, 34, 141; 105/341; 404/10

(56) References Cited

U.S. PATENT DOCUMENTS 1,356,302 A * 10/1920 Mills ..... 49/141
1,382,534 A * 6/1921 Oelenschlager et al. ..... 49/247
1,535,753 A * 4/1925 Weiser ..... 246/248
1,665,157 A * 4/1928 Dahnke ..... 49/247
2,098,284 A * 11/1937 Fraser ..... 49/247
2,137,193 A * 11/1938 Stafford ..... 49/247
2,352,310 A * 6/1944 Brown et al. ..... 49/26
3,024,550 A * 3/1962 Kudera et al. ..... 49/247
4,227,344 A * 10/1980 Poppke ..... 49/9
4,364,200 A * 12/1982 Cobb ..... 49/192
4,897,960 A * 2/1990 Barvinek et al. ..... 49/49
5,442,878 A * 8/1995 Flores ..... 49/208
5,469,660 A * 11/1995 Tamenne ..... 49/192
5,653,058 A * 8/1997 Zaimins ..... 49/208
6,327,818 B1 * 12/2001 Pease ..... 49/49

* cited by examiner

*Primary Examiner*—Gregory J. Strimbu
(74) *Attorney, Agent, or Firm*—Hugh D. Jaeger

(57) ABSTRACT

A railroad gate release mechanism which attaches between the mount arms of a railroad gate actuator and a crossing arm to prevent breakage of the crossing arm due to impingement by a vehicle. The railroad gate release mechanism includes a pivotable arm assembly which allows released movement in two directions of the crossing arm in reaction to impingement and returns the crossing arm to the original and detented position subsequent to impingement to maintain grade crossing protection. An alternative embodiment includes a pair of swing plates and an elongated arm to which is attached a crossing arm, the elongated arm with the attached crossing arm is pivoted to the pair of swing plates in such manner that the elongated arm and attached crossing arm can be pivoted aside without moving the swing plates for crossing arm maintenance without impeding vehicular traffic flow across the grade crossing.

11 Claims, 15 Drawing Sheets

GATE RELEASE MECHANISM HAVING A PIVOTABLE ARM TO FACILITATE MAINTENANCE

CROSS REFERENCES TO CO-PENDING APPLICATIONS

This patent application is a continuation-in-part of Ser. No. 09/764,802 entitled "Railroad Gate Release Mechanism" filed on Jan. 17, 2001, now U.S. Pat. No. 6,470,626.

BACKGROUND OF THE INVENTION

1. Field of the Invention

The present invention is for a railroad gate release mechanism, and in particular, is for a railroad gate release mechanism which allows for maintaining of structural integrity of a railroad grade crossing arm during and subsequent to being struck by an automotive vehicle. Although a railroad gate release mechanism is described, the release mechanism can be incorporated for other uses such as, but not limited to, parking lot gates, restricted access gates, road closure gates, toll gates, and the like.

2. Description of the Prior Art

Railroad crossing grades are protected by railroad grade crossing arms which are stored substantially in a vertical position and which are actuated by railroad gate actuators which reorient the crossing arms to a horizontal position across a railroad grade crossing to warn operators of vehicles of oncoming train traffic and to physically place a barrier in the form of a crossing arm at both sides of the railroad grade crossing to prevent passage of a vehicle into the railroad grade crossing. Motorists unaware of the movement of a crossing arm may impinge the crossing arm to the extent that physical damage occurs where the crossing arm is broken and parted from the railroad gate actuator. Such an occurrence can compromise the safety of the railroad grade crossing in that other motorists will not be warned of impending danger due to the destruction of the crossing arm. Such occurrences compromise safety, as well as add a financial maintenance burden. Maintenance of prior art railroad grade crossing arms sometimes required that the railroad grade crossing arms be deployed across the railroad crossing grade, thus providing a nuisance and hinderance to the smooth flow of vehicle traffic across the railroad crossing grade.

SUMMARY OF THE INVENTION

The general purpose of the present invention is to provide a railroad gate release mechanism.

According to one embodiment of the present invention, there is provided a railroad gate release mechanism for attachment between a railroad gate actuator and a crossing arm including opposing channel-shaped brackets which attach to a railroad gate actuator and which also serve as mounting structure for other components of the railroad gate release mechanism. A pivotable arm assembly, to which a crossing arm is attached, pivotally mounts between bearing plates located on the inwardly facing surfaces of the opposing channel-shaped brackets. The pivotable arm assembly is influenced by a detent and plunger arrangement which maintains a perpendicular relationship of the pivotable arm assembly and the attached crossing arm with respect to the railroad gate actuator until acted upon by outside forces, such as a vehicle impinging the crossing arm. Such impingement causes the railroad gate release mechanism, with the attached crossing arm, to pivotally overcome the influence of the detent and plunger arrangement and to swing substantially horizontally out of the way of the impinging vehicle without functional damage to the crossing arm. Such pivotal breaking away substantially reduces the possibility of breakage of the crossing arm, as little bending moment is actually applied to the crossing arm itself due to the substantially unrestricted movement allowed by the railroad gate release mechanism. Subsequent to such impingement and when the vehicle has ceased to contact the crossing arm, spring assemblies function to return the pivotable arm assembly of the railroad gate release mechanism, with the attached crossing arm, to the detented position to continue to offer gated protection at the crossing grade. A shock absorber allows for rapid rate pivoting of the pivotable arm assembly in one direction during impingement and allows for a slower rate return of the pivotable arm assembly in the return direction subsequent to impingement. A centering spring assists in returning of the pivotable arm assembly to the detented position.

An alternative embodiment of the present invention involves a railroad gate release mechanism which allows maintenance of the a railroad gate release mechanism without requiring sustained horizontal positioning of the crossing arm across the railroad crossing grade. Such a device includes an additional pivotal arrangement and a readily detachable bracket for pivotal release of the crossing arm from the pivotable arm assembly to facilitate maintenance functions.

One significant aspect and feature of the present invention is a railroad gate release mechanism which secures between the mount arms of a railroad gate actuator and a crossing arm.

Another significant aspect and feature of the present invention is a railroad gate release mechanism which when impinged releasably allows breakaway pivoting in two directions of a crossing arm from a normal and detented position to prevent damage to the crossing arm.

Another significant aspect and feature of the present invention is a railroad gate release mechanism which allows return pivoting of a crossing arm to a normal and detented position subsequent to breakaway pivoting caused by impingement.

Still another significant aspect and feature of the present invention is a railroad gate release mechanism which offers grade crossing protection subsequent to crossing arm impingement.

Yet another significant aspect and feature of the present invention is the use of cables attached to a pivotable arm assembly which connect to springs in spring assemblies which are compressed during impingement with the front side of a crossing arm to subsequently power the return of the pivotable arm assembly and attached crossing arm to an original and detented position.

A further significant aspect and feature of the present invention is the use of a shock absorber which allows rapid deployment and release of a pivotable arm assembly and attached crossing arm during impingement and which allows return of the pivotable arm assembly and attached crossing arm at a slower rate subsequent to impingement, whereby the slower return rate reduces return overshoot of the pivotable arm assembly and the crossing arm.

A still further significant aspect and feature of the present invention is the use of a centering spring assembly which urges the pivotable arm assembly into a normal and detented position when the crossing arm is impinged from the rear side.

Yet another significant aspect and feature of the present invention is a pivotable arm assembly which allows maintenance of a crossing arm without requiring sustained horizontal positioning of the crossing arm across the railroad crossing grade.

Having thus described an embodiment of the present invention and set forth significant aspects and features thereof, it is the principal object of the present invention to provide a railroad gate release mechanism.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
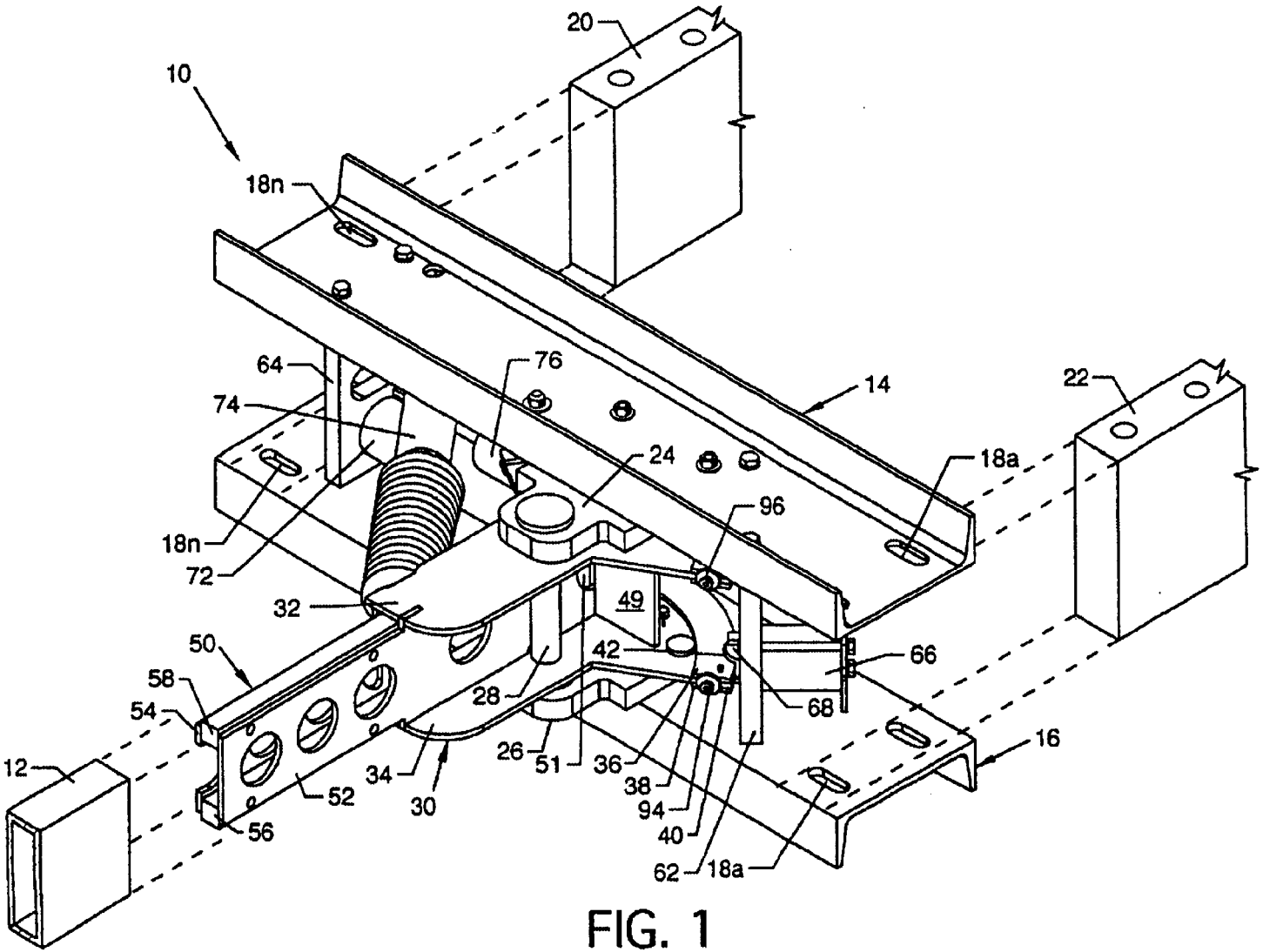
FIG. 1 illustrates an isometric view of a railroad gate release mechanism, the present invention, along with portions of mount arms and a crossing arm which are associated therewith in use.
Figure 1A:
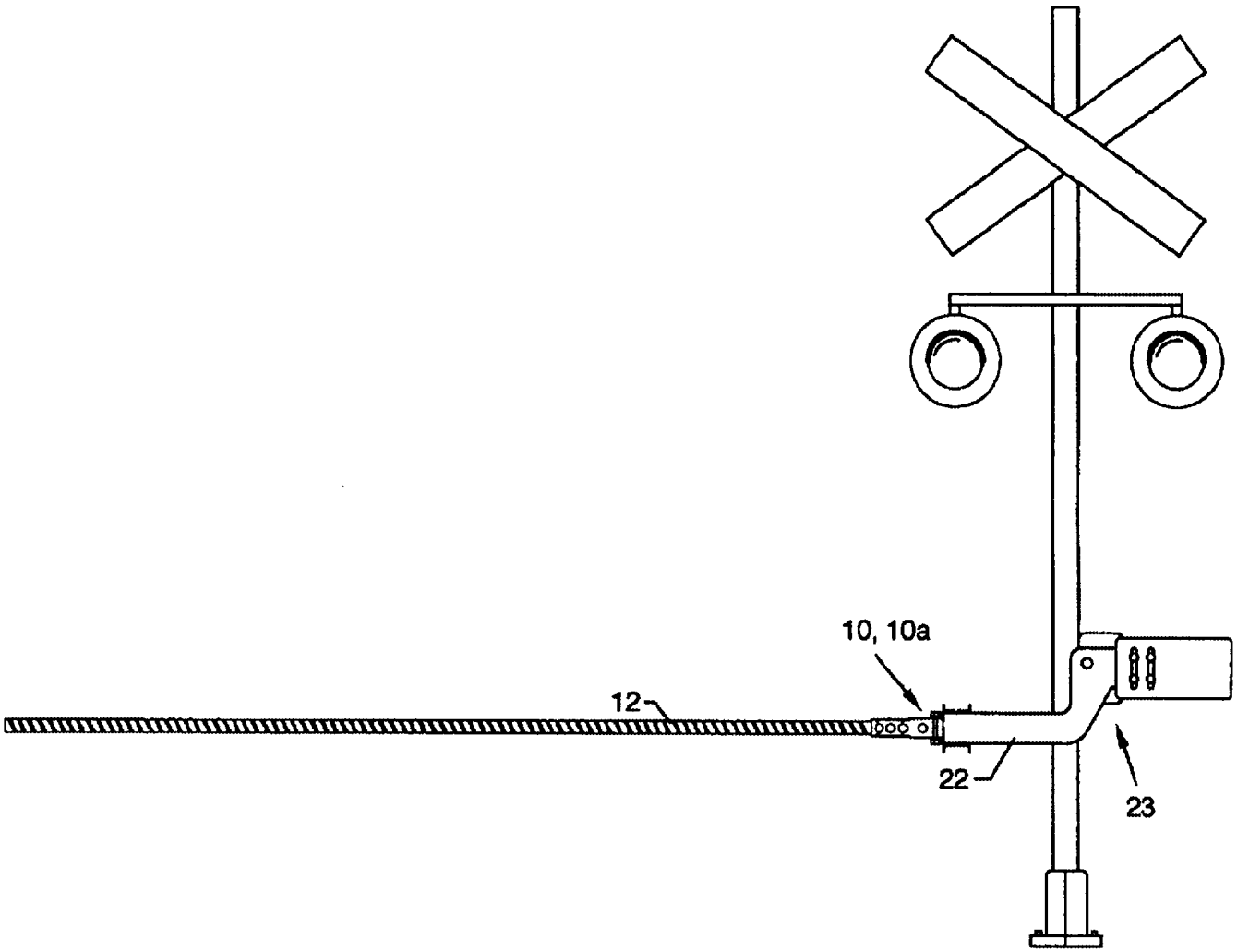
FIG. 1*a* illustrates the use of the railroad ante release mechanism in combination with a prior art actuator.

FIG. 1 illustrates an isometric view of the railroad gate release mechanism 10, the present invention, shown in the position which it has between mount arms 20 and 22 of a railroad gate actuator 23 (FIG. 1*a*) and a crossing arm 12 when the crossing arm 12 is in the horizontal position, such as for stopping of traffic at a railroad grade crossing.

Figure 2:
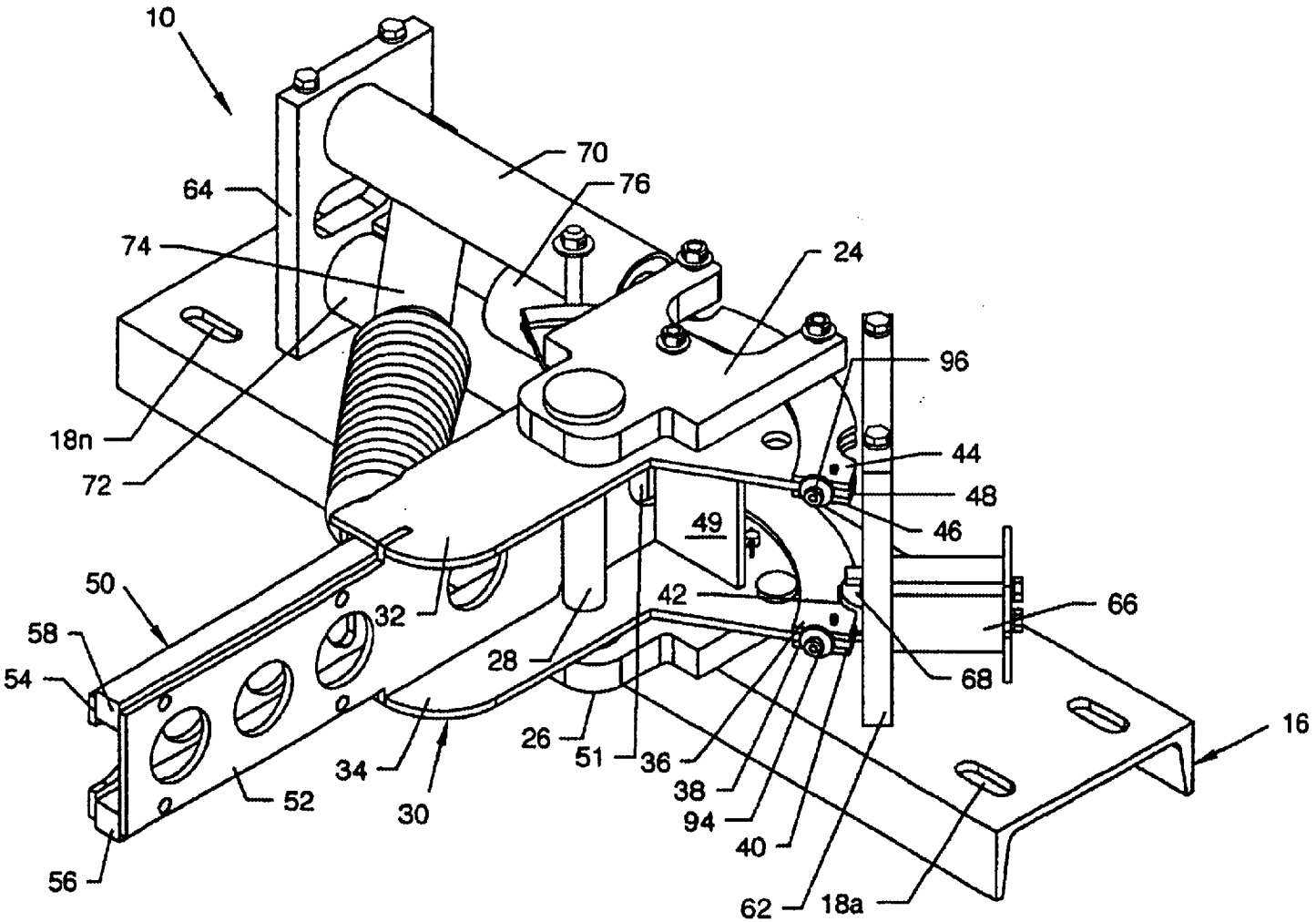
FIG. 2 illustrates the railroad gate release mechanism with an upper bracket removed.

FIG. 2 illustrates the railroad gate release mechanism 10 with an upper bracket 14 removed for the purpose of clarity. With respect to FIGS. 1 and 2, the invention is further described. Partial or fully visible components of the railroad gate release mechanism 10 include opposing upper and lower brackets 14 and 16 each having a plurality of mounting holes 18*a*–18*n* for attachment to the mount arms 20 and 22 of a railroad gate actuator, as well as other holes for mounting of other components thereto. Opposing upper and lower bearing plates 24 and 26 suitably secure to the inwardly facing surfaces of the upper and lower brackets 14 and 16 to accommodate a vertically oriented pivot pin 28 and a pivotable arm assembly 30. The pivotable arm assembly 30 aligns between the upper and lower brackets 14 and 16 and is pivotally secured therebetween by the pivot pin 28. The pivotable arm assembly 30 includes, in part, an arm 50 and opposing geometrically configured and horizontally aligned upper and a lower swing plates 32 and 34. Arm 50 serves as a mount for the crossing arm 12, shown in FIG. 1. One end of the lower swing plate 34 is in the shape of an arc to which opposing cable guide plates 36 and 38 are opposingly and suitably secured. The cable guide plates 36 and 38 extend beyond the arced end of the lower swing plate 34 to form a cable channel 40 therebetween. A semi-circular detent 42 is comprised of semi-circular cutouts in each of the cable guide plates 36 and 38 the combination of which forms detent 42. The upper swing plate 32 is fashioned similarly to the lower swing plate 34 and includes opposing cable guide plates 44 and 46 to form a cable channel 48. Tabbed brace plates 49 and 51 (FIG. 4) also align between the upper swing plate 32 and the lower swing plate 34 and abut opposing sides of a right arm plate 52. The arm 50 aligns and suitably secures between the upper swing plate 32 and the lower swing plate 34. The arm 50 includes the right arm plate 52 aligned between the full length of the upper swing plate 32 and the lower swing plate 34. The right arm plate 52 extends outwardly beyond the upper swing plate 32 and the lower swing plate 34 and, as such, serves as a mount for a left arm plate 54 and spacer bars 56 and 58 disposed therebetween. A portion of the right arm plate 52 extends along the length of the upper swing plate 32 and the lower swing plate 34. A right brace plate 62 and a left brace plate 64 are mounted vertically between the upper bracket 14 and the lower bracket 16. A plunger housing 66 including a spring loaded movable plunger 68 mounts to the right brace plate 62. The plunger 68 engages the detent 42 of the pivotable arm assembly 30 to maintain the position of the pivotable arm assembly 30 where the crossing arm 12 is extended across a grade crossing. The left brace plate 64 also serves as a mounting plate for upper and lower spring assemblies 70 and 72, a shock absorber 74, and a centering spring assembly 76.

Figure 3:
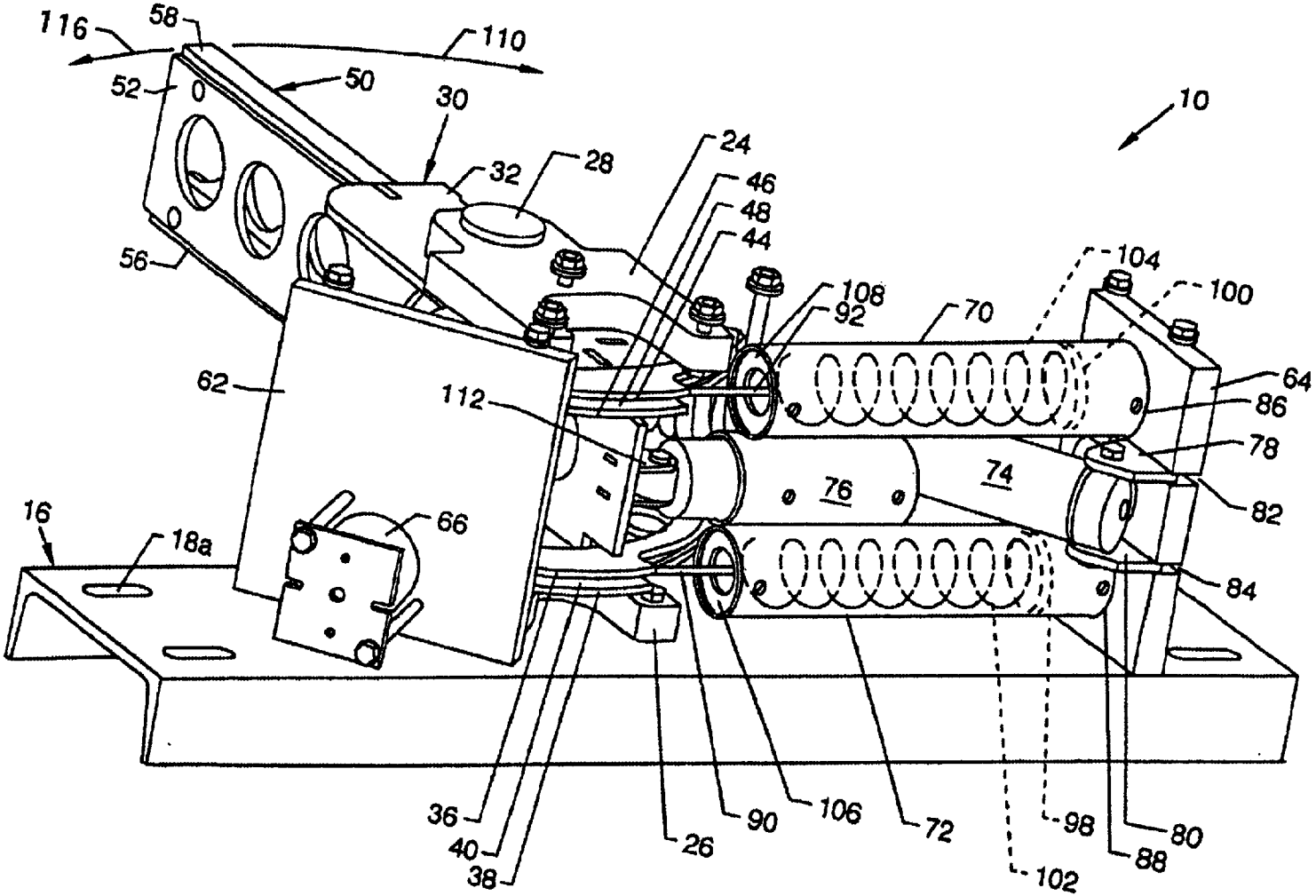
FIG. 3 illustrates a rear isometric view of the elements of FIG. 2.

FIG. 3 illustrates a rear isometric view of the elements of FIG. 2. Illustrated in particular is the relationship of the pivotable arm assembly 30 to the upper and lower spring assemblies 70 and 72, the centering spring assembly 76, and the shock absorber 74. Opposing mounting brackets 78 and 80 align and suitably secure into slots 82 and 84, respectively, in the left brace plate 64. One end of the shock absorber 74 pivotally secures to the mounting brackets 78 and 80, and the other end of the shock absorber 74 pivotally secures to a pair of mounting brackets on the arm 50. The shock absorber 74 when moved to the compressed position allows rapid movement of the pivotable arm assembly 30 and allows a slower rate of movement when returning to the extended position to suitably control the return rate of the pivotable arm assembly 30 subsequent to impingement of the crossing arm 12. The horizontally oriented upper and lower spring assemblies 70 and 72 align and suitably secure in bores 86 and 88 in the left brace plate 64. One end of cables 90 and 92 secure by ball ends 94 and 96 (FIG. 2) and align in the cable channels 40 and 48 of the lower and upper swing plates 34 and 32, respectively. The other ends of the cables 90 and 92 secure to circular plates 98 and 100 located inside of the lower and upper spring assemblies 72 and 70. Springs 102 and 104 are located interior to the lower and upper spring assemblies 72 and 70 between the circular plates 98 and 100 and the inward facing ends 106 and 108 of the lower and upper spring assemblies 72 and 70. Movement of the pivotable arm assembly 30 including its arm 50 in a direction as indicated by arrow 110 causes compression of the springs 102 and 104 to provide for subsequent spring powered action of the pivotable arm assembly 30 to return the pivotable arm assembly 30 to its normal detented position subsequent to impingement of the crossing arm 12.

Figure 4:
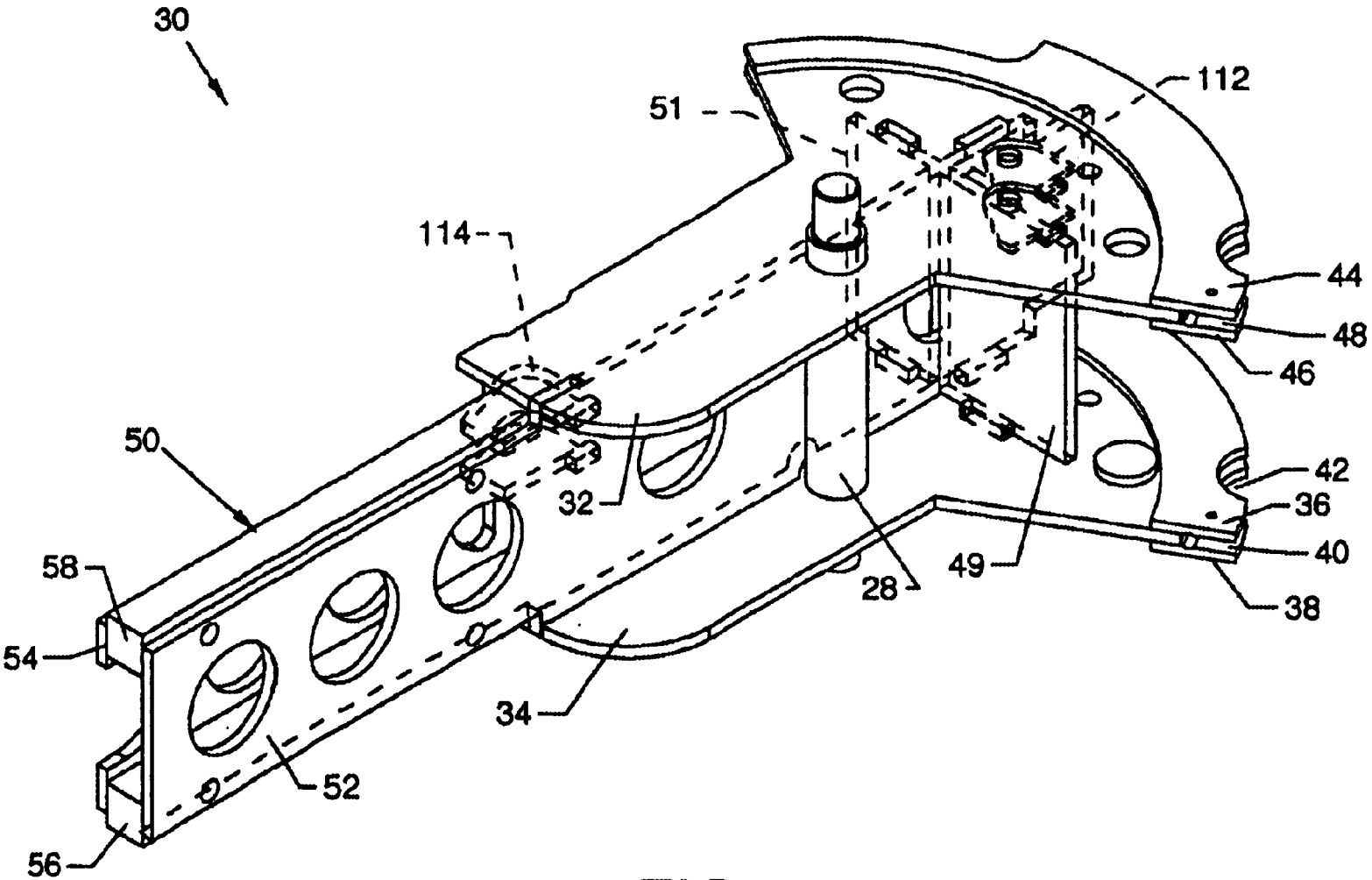
FIG. 4 illustrates an isometric view of the pivotable arm assembly.

FIG. 4 illustrates an isometric view of the pivotable arm assembly 30. Illustrated in particular are the tabbed brace plates 49 and 51 extending vertically and secured between the upper swing plate 32 and the lower swing plate 34. One set of mounting brackets 112 secures at one end of the right arm plate 52 to serve as a mount for one end of the centering spring assembly 76 (FIG. 3), and another set of mounting brackets 114 secures at a mid-position on the left arm plate 54 to serve as a mount for one end of the shock absorber 74 of FIG. 1.

Figure 5:
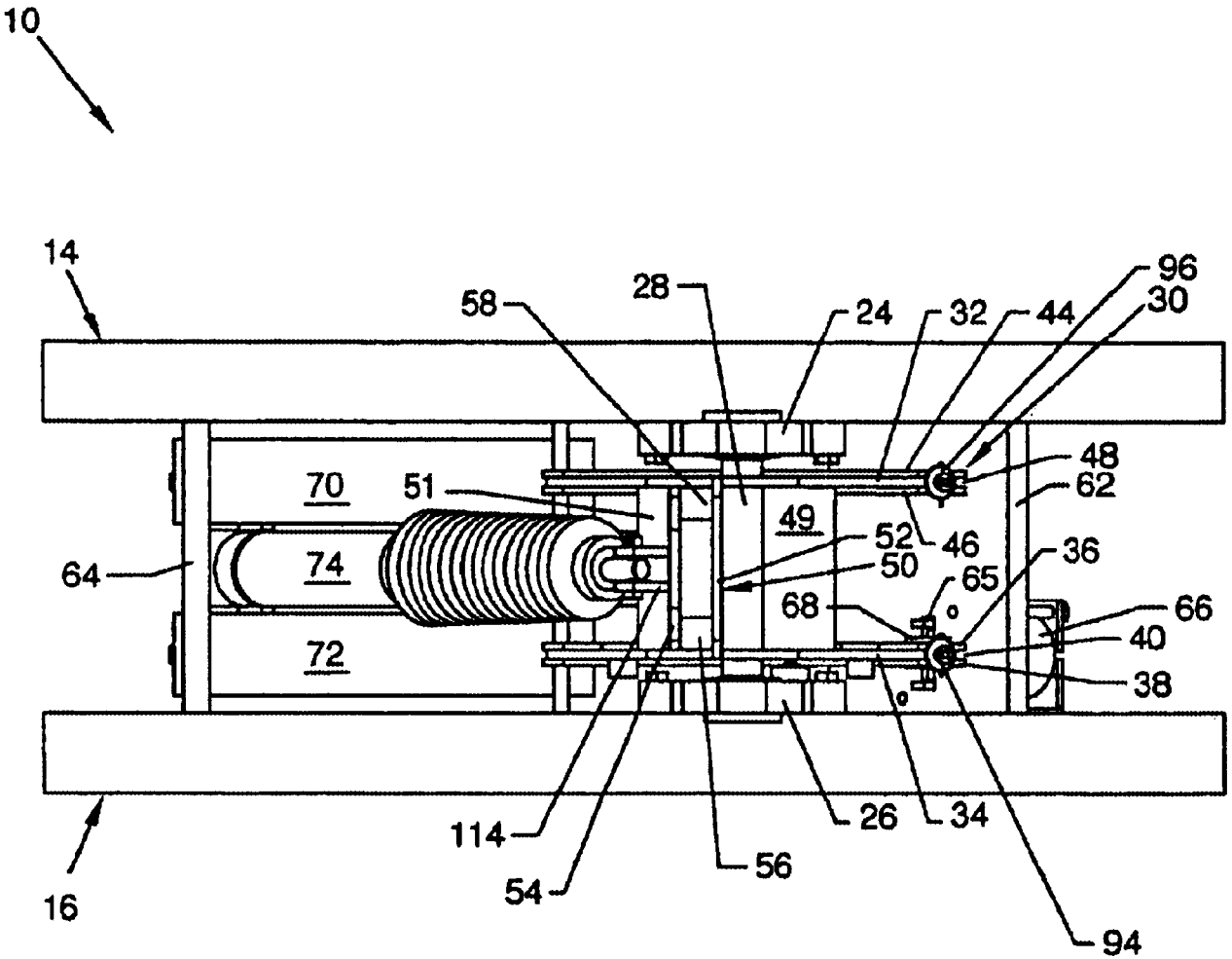
FIG. 5 illustrates an end view of the railroad gate release mechanism.

FIG. 5 illustrates an end view of the railroad gate release mechanism 10. A rectangular hole 65 is provided in the right mounting plate 62 to accommodate the plunger 68 and to accommodate other mounting geometry of the plunger housing 66.

Figure 6:
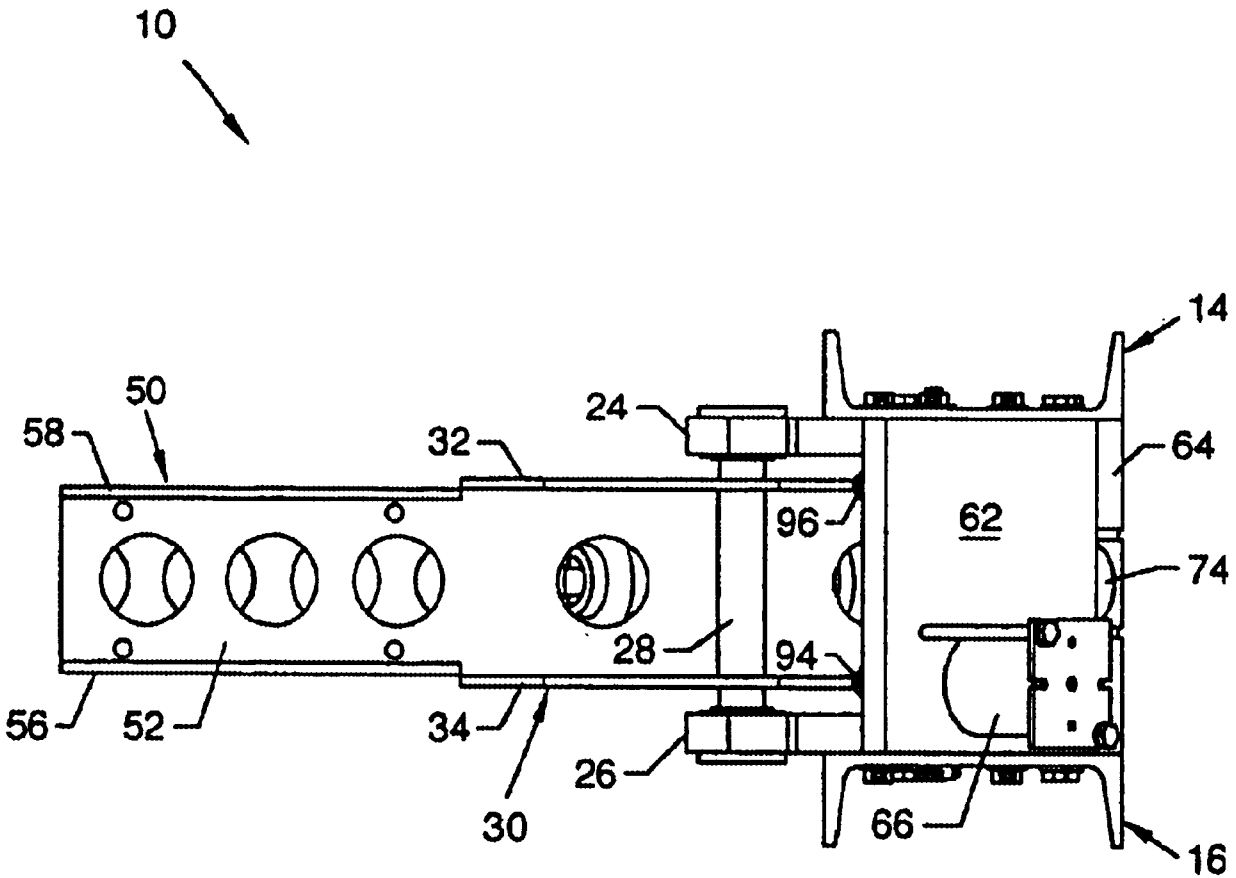
FIG. 6 illustrates a side view of the railroad gate release mechanism.

FIG. 6 illustrates a side view of the railroad gate release mechanism 10, where all numerals correspond to those elements previously described.

Figure 7:
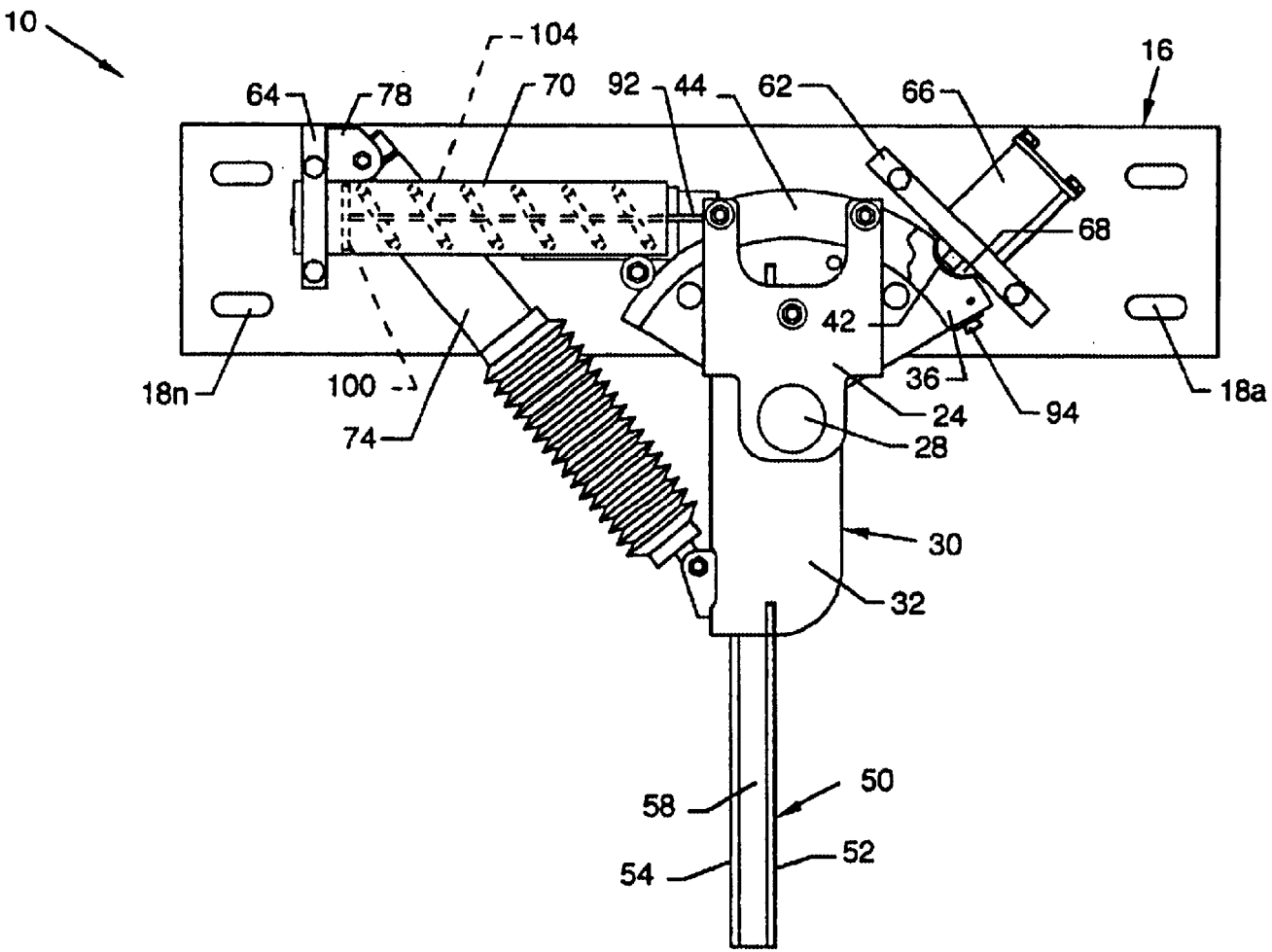
FIG. 7 illustrates a top view of the railroad gate release mechanism in partial cutaway showing its normal position when in use.

FIG. 7 illustrates a top view of the railroad gate release mechanism 10, in partial cutaway, showing its normal position when in use, where all numerals correspond to those elements previously described. The cable guide plate 44 and underlying cable guide plate 46 are shown in partial cutaway to reveal the detent 42 in the lower swing plate 34 of the pivotable arm assembly 30. The spring loaded plunger 68 engages the detent 42 of the pivotable arm assembly 30 to maintain the position of the pivotable arm assembly 30 where the crossing arm 12 (FIG. 1) is extended across a grade crossing. The spring loaded plunger 68 is of sufficient strength to maintain the pivotable arm assembly 30 a including its arm 50 and an attached crossing arm 12 in the desired orientation during raising and lowering and to maintain the desired orientation extending across the crossing grade unless impinged by a vehicle.

MODE OF OPERATION

Figure 8:
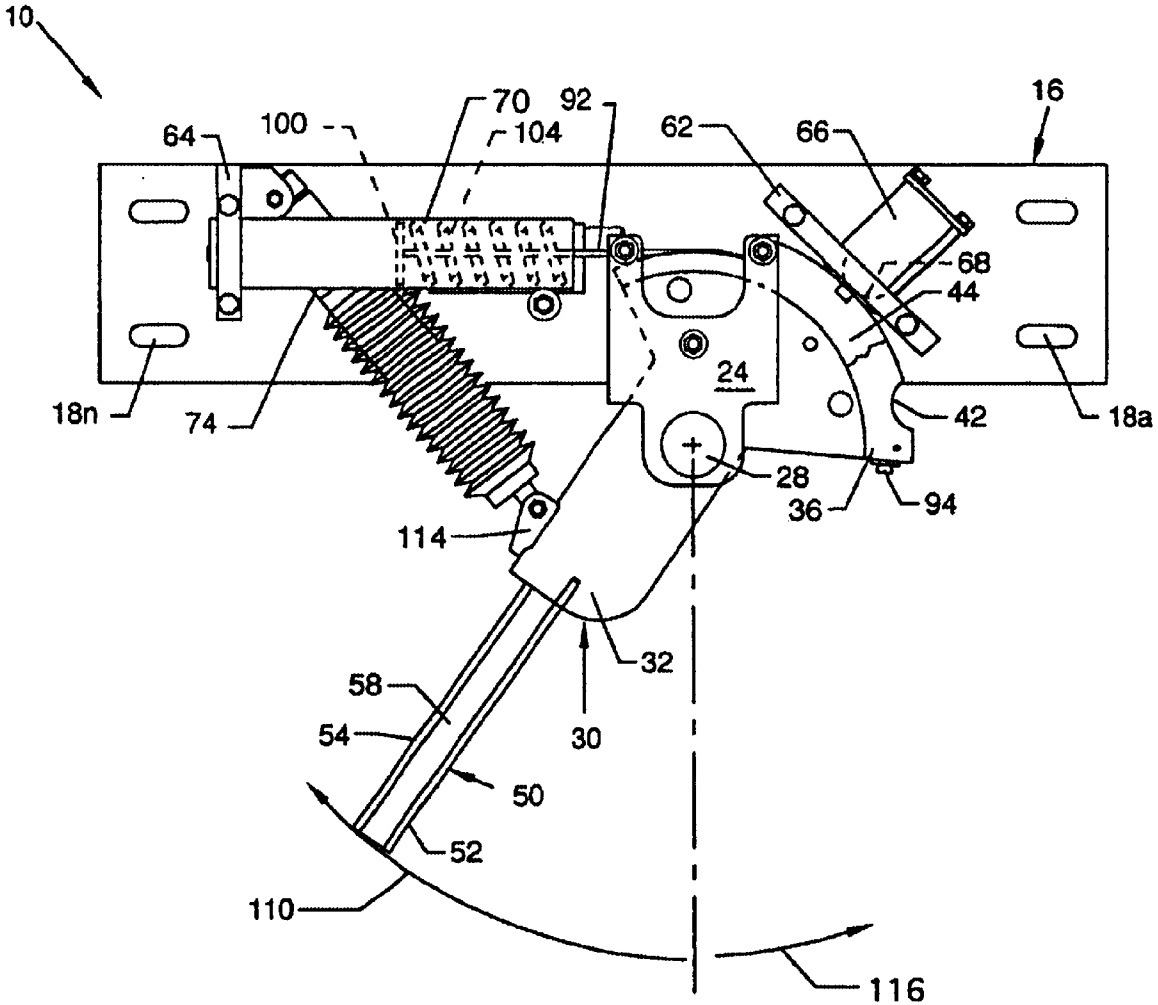
FIG. 8 illustrates a top view of the railroad gate release mechanism in partial cutaway showing how it moves when the crossing arm is impinged by a vehicle or other object.

FIG. 8 illustrates a top view of the railroad gate release mechanism 10, in partial cutaway, and best illustrates the mode of operation of the railroad gate release mechanism 10, where all numerals correspond to those elements previously described. Pivotal arm relief is provided for front side or rear side impingement of the attached crossing arm 12. Impingement of the front side of the attached crossing arm 12 by a vehicle or other object forces pivoting of the pivotable arm assembly 30 about the pivot pin 28, as shown by arrow 110. Such pivoting allows, for purposes of example and illustration, rotation of 40° of the pivoting arm assembly 30 about the pivot pin 28. Such forced pivoting causes disengagement of the spring loaded plunger 68 from the detent 42 of the pivotable arm assembly 30, thus allowing the pivotable arm assembly 30 and attached crossing arm 12 to pivot, thereby preserving the integrity of the attached crossing arm 12. Pivoting of the pivotable arm assembly 30 and attached crossing arm 12 is allowed at a suitable and rapid rate and is not greatly influenced by the shock absorber 74. However, return of the pivotable arm assembly 30 and attached crossing arm 12 to the detented position is influenced by the shock absorber 74 which acts to allow return pivoting at a rate much less than that during impingement-caused pivoting. During impingement-caused pivoting of the pivotable arm assembly 30 and attached crossing arm 12, spring 104 in the upper spring assembly 70 and spring 102 in the lower spring assembly 72 are compressed by the movement of the cables 92 and 90, respectively, which are attached in the cable channels 48 and 40 located on the ends of the upper swing plate 32 and the lower swing plate 34, respectively. Such spring compression provides force to return the pivotable arm assembly 30 and attached crossing arm 12 towards and into the detented position at a controlled rate as provided by the shock absorber 74, as previously described.

Impingement of the rear side of the attached crossing arm 12 provides for disengagement of the spring loaded plunger 68 from the detent 42 of the pivotable arm assembly 30, thus allowing the pivotable arm assembly 30 and attached crossing arm 12 to pivot, thereby preserving the integrity of the crossing arm 12. Such pivoting allows, for purposes of example and illustration, rotation of 15° of the pivoting arm assembly 30 about the pivot pin 28 as generally shown by arrow 116. The centering spring assembly 76 urges and assists the pivotable arm assembly 30 to return to a normal and detented position.

Figure 9:
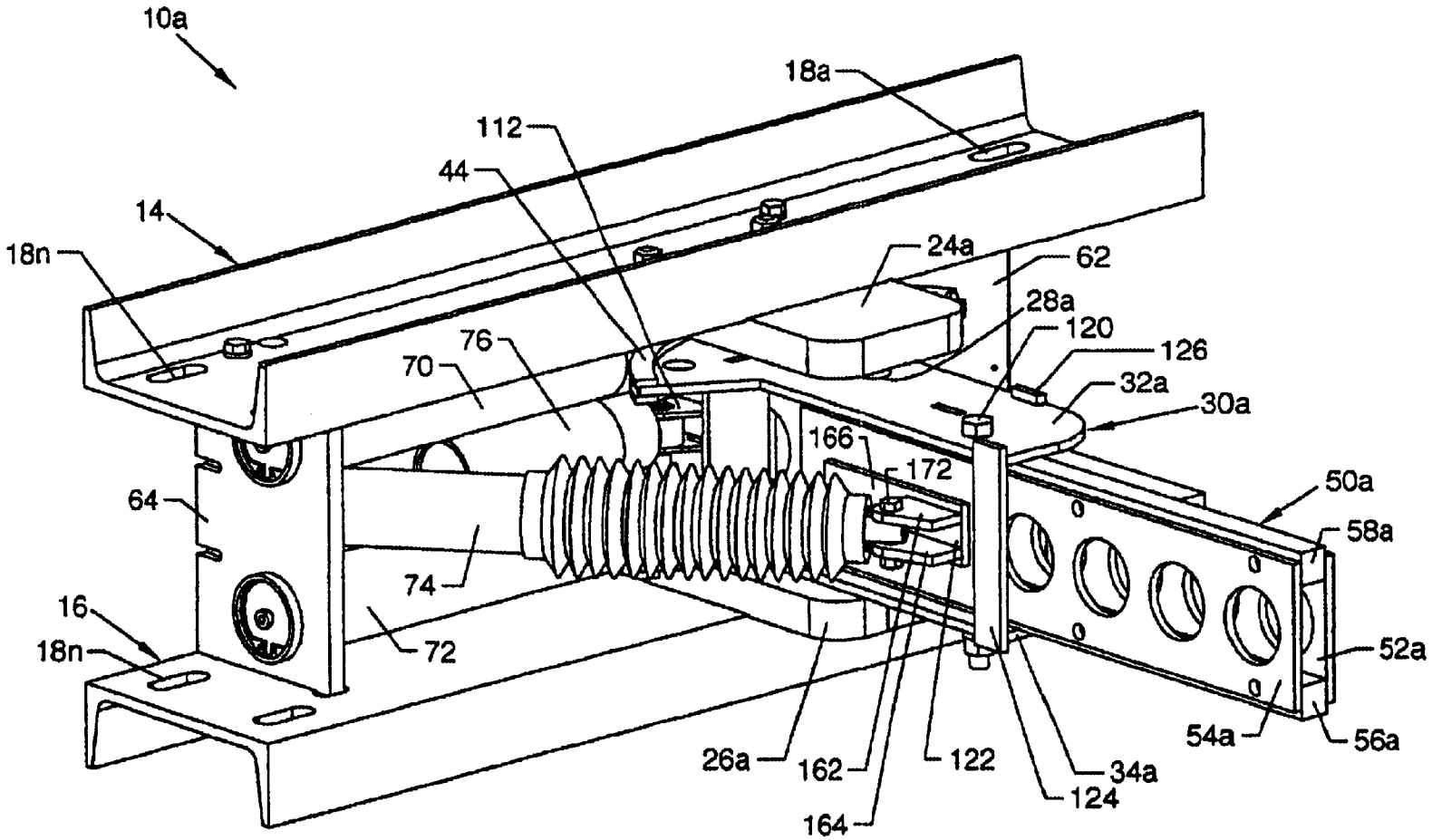
FIG. 9, an alternate embodiment, illustrates an isometric view of one side of a railroad gate release mechanism incorporating the functions of and the majority of the components of the previously illustrated railroad gate release mechanism shown in the position when a crossing arm is in the horizontal position, such as for stopping of traffic at a railroad grade crossing.

FIG. 9, an alternate embodiment, illustrates an isometric view of one side of a railroad gate release mechanism 10*a* incorporating the functions of and the majority of the components of the previously described railroad gate release mechanism 10 shown in the position when the crossing arm 12 is in the horizontal position, such as for stopping of traffic at a railroad grade crossing. The railroad gate release mechanism 10*a* includes an arm 50*a* which can be positioned for maintenance to an attached crossing arm without obstruction to vehicular grade traffic. Previously incorporated upper and lower bearing plates 24 and 26, respectively, are replaced by upper and lower bearing plates 24*a* and 26*a* each incorporating bearings (not shown) in their inwardly facing surfaces for accommodation of opposing ends of a pivot pin 28*a* (FIG. 11) extending between, as well as slightly beyond, upper and lower swing plates 32*a* and 34*a*, which partially comprise a pivotable arm assembly 30*a* similar in functionality in most respects to the pivotable arm assembly 30. The upper and lower swing plates 32*a* and 34*a* of the pivotable arm assembly 30*a* are modified slightly to allow for pivotal accommodation of the arm 50*a*, as later described in detail. Additionally, an arm pivot pin 120 extends vertically through the upper and lower swing plates 32*a* and 34*a* and through the arm 50*a* to pivotally secure the arm 50*a* to the upper and lower swing plates 32*a* and 34*a*. To accommodate maintenance, a detachable bracket 122 secures to the arm 50*a*, as later described in detail, to serve as a pivotable attachment point for connection to the shock absorber 74. Vertically oriented stop bars 124 and 126 align, as illustrated, between the upper and lower swing plates 32*a* and 34*a* to limit pivotal rotation of the arm 50*a* about the arm pivot pin 120 when crossing arm maintenance is accomplished. Previously described and unchanged components function as described in the previous figures.

Figure 10:
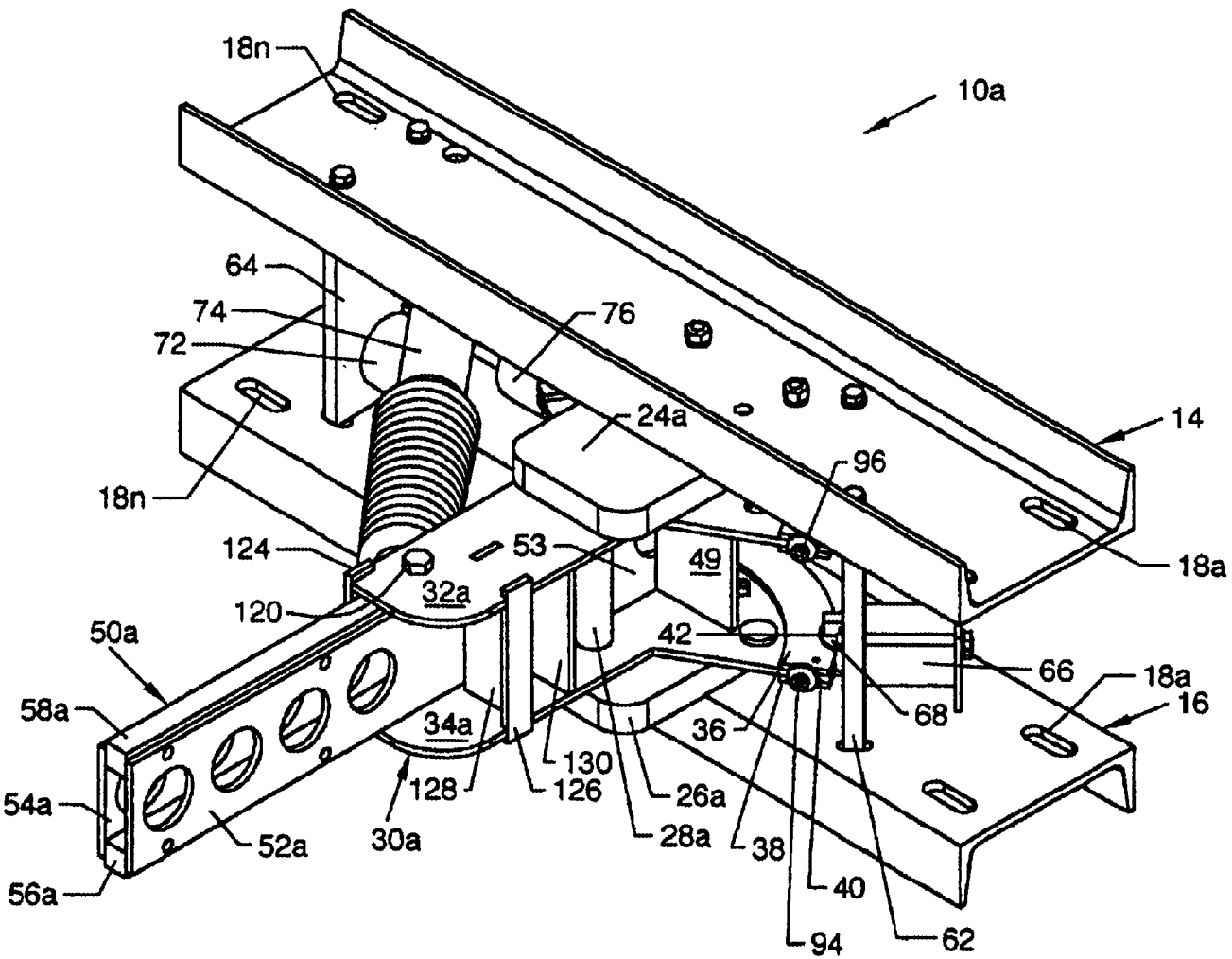
FIG. 10 illustrates an isometric view of the opposing side of the components shown in FIG. 9 of a railroad gate release mechanism incorporating the functions of and the majority of the components of the previously illustrated railroad gate release mechanism shown in the position when a crossing arm is in the horizontal position, such as for stopping of traffic at a railroad grade crossing.

FIG. 10 illustrates an isometric view of the opposing side of the components shown in FIG. 9 of a railroad gate release mechanism incorporating the functions of and the majority of the components of the previously described railroad gate release mechanism 10 shown in the position when the crossing arm 12 is in the horizontal position, such as for stopping of traffic at a railroad grade crossing. Illustrated in particular are the vertically oriented stop bars 124 and 126 extending between the upper and lower swing plates 32*a* and 34*a*, as well as additional vertically oriented bracing plates 128 and 130 extending between the upper and lower swing plates 32*a* and 34*a* and partially along and abutting a vertically aligned tabbed brace plate 53, later described in detail.

Figure 11:
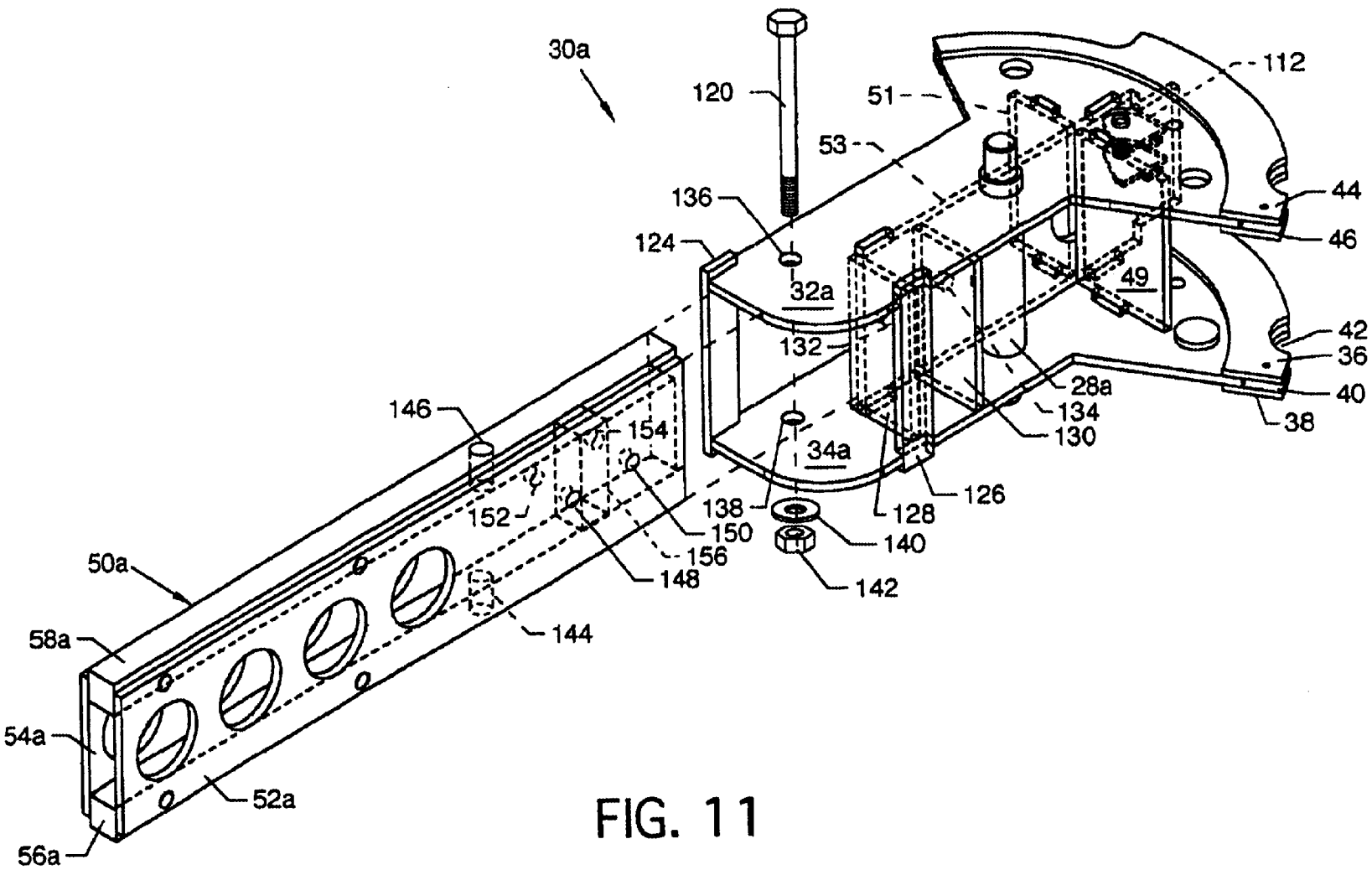
FIG. 11 illustrates a semi-exploded isometric view of the pivotable arm assembly of the alternate embodiment.
Figure 12:
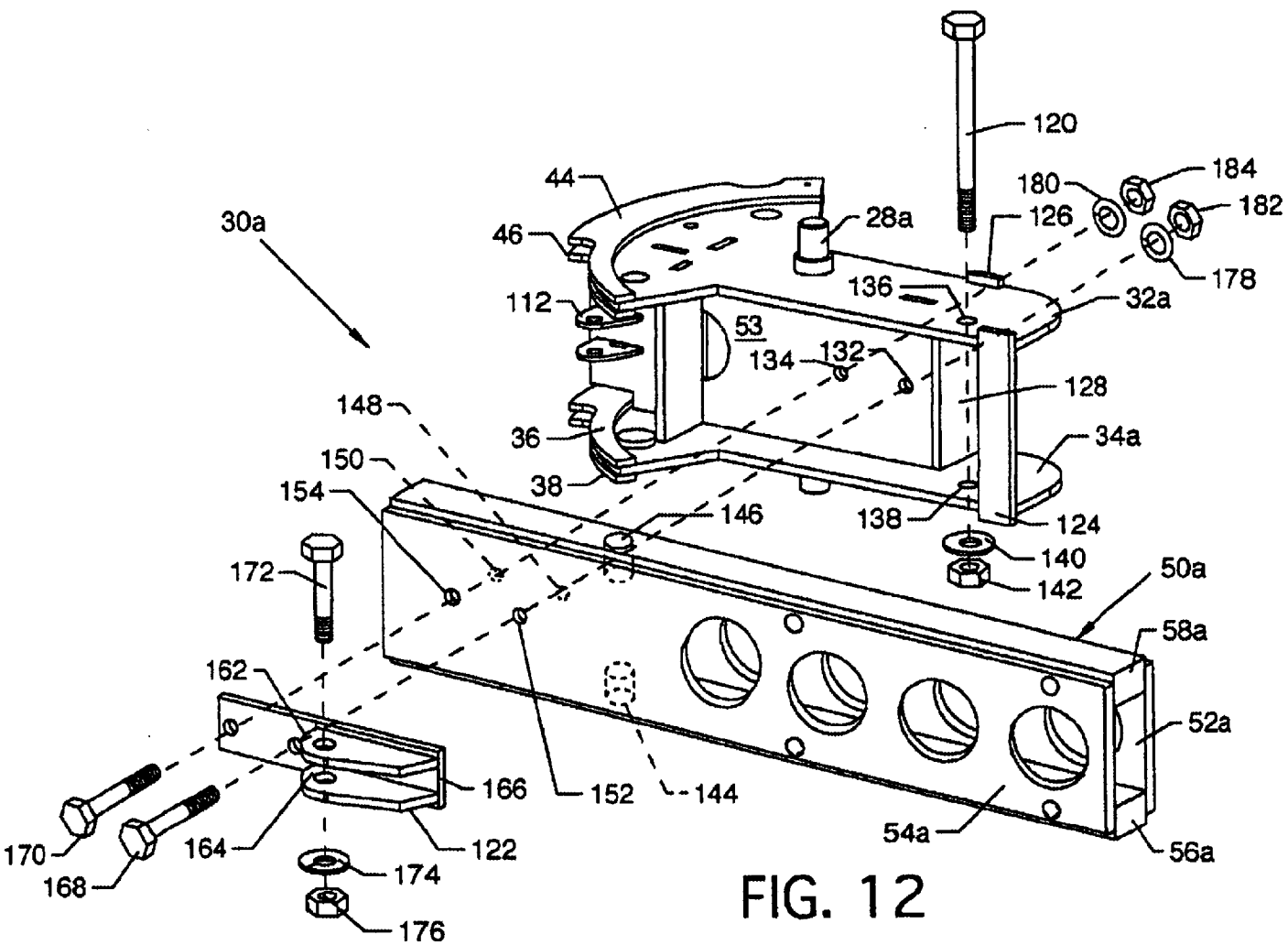
FIG. 12 illustrates a semi-exploded isometric view of the pivotable arm assembly of the alternate embodiment.

FIG. 11 illustrates a semi-exploded isometric view of the pivotable arm assembly 30*a*, similar in many respects to the pivotable arm assembly 30 previously described. Included in the pivotable arm assembly 30*a* are the tabbed brace plates 49 and 51 extending vertically and secured between the upper swing plate 32*a* and the lower swing plate 34*a*, as well as the vertically oriented bracing plates 128 and 130 extending between the upper and lower swing plates 32*a* and 34*a* in juxtaposition to a tabbed brace plate 53. Vertically aligned tabbed brace plate 53 is also secured between the upper swing plate 32*a* and the lower swing plate 34*a* to bridge between the bracing plates 128 and 130 and the tabbed brace plates 49 and 51. The tabbed brace plate 53 serves as an attachment plate for the connection between the shock absorber 74 and the pivotal arm assembly 30*a*. Body holes 132 and 134 are included extending through the tabbed brace plate 53 as also shown in FIG. 12. A hole 136 in the upper swing plate 32*a* and a hole 138 in the lower swing plate 34*a* are included to foster pivotal attachment of the arm 50*a* in conjunction with the arm pivot pin 120 and accompanying washer 140 and nut 142. A mounting bracket set 112 is relocated to secure at one end of the tabbed brace plate 53 to serve as a mount for one end of the centering spring assembly 76 (FIG. 9).

The pivotable arm assembly 30*a* also includes an arm 50*a*. Arm 50*a* serves as a mount for the crossing arm 12, shown in FIG. 1, and is fashioned to include horizontally aligned spacer bars 56*a* and 58*a* aligned between and secured to vertically aligned right arm plate 52*a* and left arm plate 54*a*. Pivot holes 144 and 146 extend vertically through the spacer bars 56*a* and 58*a*, respectively. Body holes 148 and 150 extend through the right arm plate 52*a* in alignment with body holes 152 and 154 in the left arm plate 54*a*. A support bar 156 aligns between the inwardly facing surfaces of the right arm plate 52*a* and the left arm plate 54*a*. The support bar 156 is also flanked by the body holes 148, 150, 152 and 154 to provide for support between the right arm plate 52*a* and the left arm plate 54*a* when the arm 50*a* is firmly secured to the tabbed brace plate 53 by machine screws 168 and 170 (FIG. 12). The arm 50*a* secures in the position shown in FIG. 10. Pivot holes 144 and 146 are aligned with the holes 138 and 136 in the lower swing plate 34*a* and the upper swing plate 32*a*, respectively, and pivotally secured thereto by the arm pivot pin 120 extending therethrough. Washer 140 and nut 142 secure to the bottom end of the arm pivot pin 120.

FIG. 12 illustrates a semi-exploded isometric view of the pivotable arm assembly 30*a*. Shown in particular is the relationship of the arm 50*a* and the detachable bracket 122 to the tabbed brace plate 53. As previously described, the arm pivot pin 120 pivotally secures the arm 50*a* between the upper swing plate 32*a* and the lower swing plate 34*a* in a position behind the stop bar 124. Further securing of the arm 50*a* is accomplished by securing the detachable bracket 122 to the arm 50*a* and to the tabbed brace plate 53. The detachable bracket 122 includes holed plates 162 and 164 attached to a holed base plate 166. Machine screws 168 and 170 extend, respectively, through the holed base plate 166, through the body holes 152 and 154 in the left arm plate 54*a*, through body holes 148 and 150 in the right arm plate 52*a*, and through holes 132 and 134 in the tabbed brace plate 53 thereupon which washers 178, 180 and nuts 182 and 184, respectively, are applied. A machine screw 172, a washer 174, and a nut 176 are provided to attach the shock absorber 74 to the detachable bracket 122, and thus the arm 50*a* and tabbed brace plate 53, as shown in FIG. 9.

Figure 13:
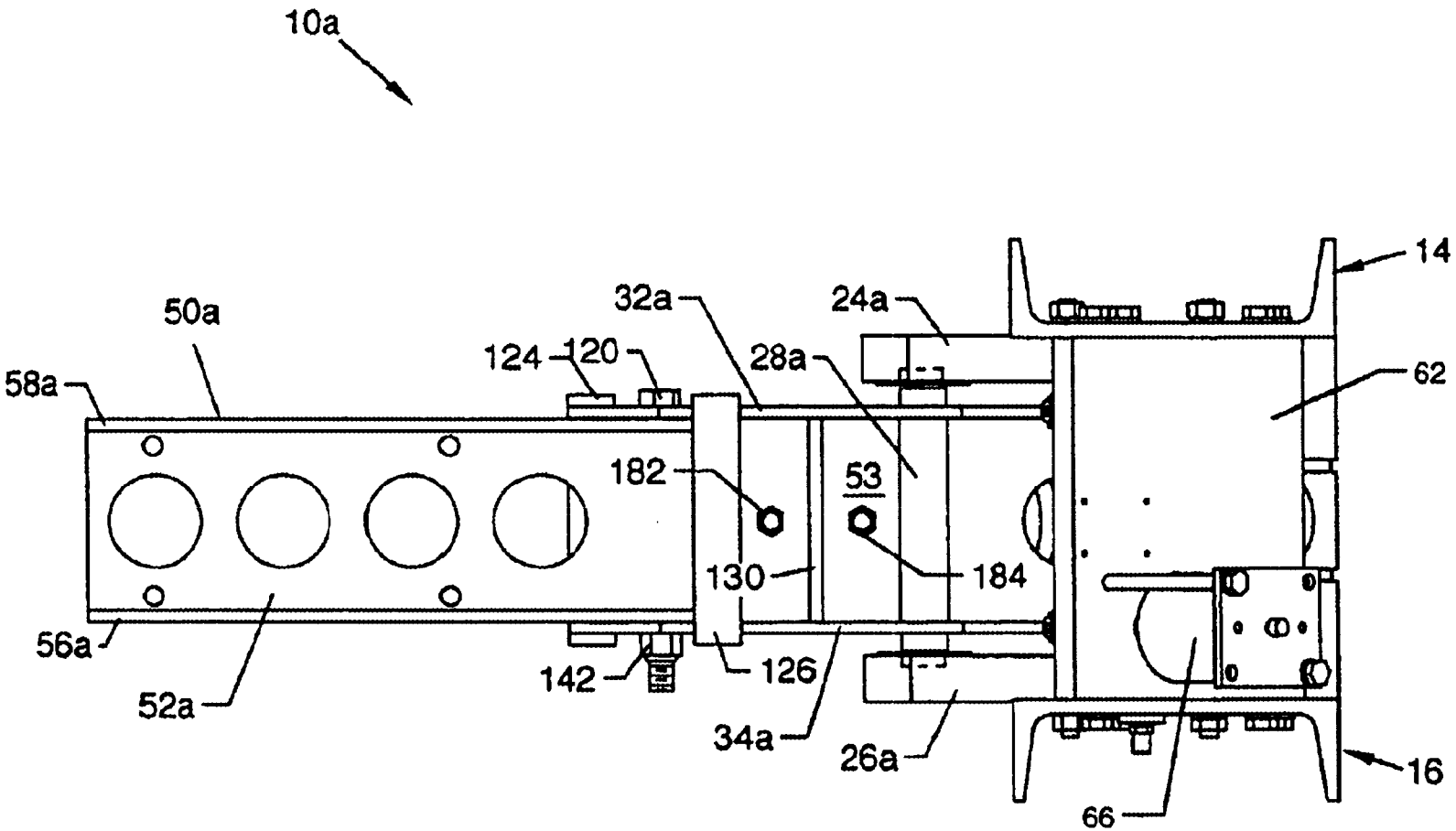
FIG. 13 illustrates a side view of the railroad gate release mechanism of the alternate embodiment; and, FIG. 14 illustrates a top view of the railroad gate release mechanism of the alternate embodiment where the upper bracket is removed for purpose of clarity, this figure best illustrating the mode of operation with respect to the arm of the railroad gate release mechanism.

FIG. 13 illustrates a side view of the railroad gate release mechanism 10*a*, where all numerals correspond to those elements previously described. Shown in particular is the capture of the opposing ends of the pivot pin 28*a* by the upper and lower bearing plates 24*a* and 26*a*. Also shown are the nuts 182 and 184 which aid in the securing of or the unsecuring of the arm 50*a* from the tabbed brace plate 53.

MODE OF OPERATION

Figure 14:
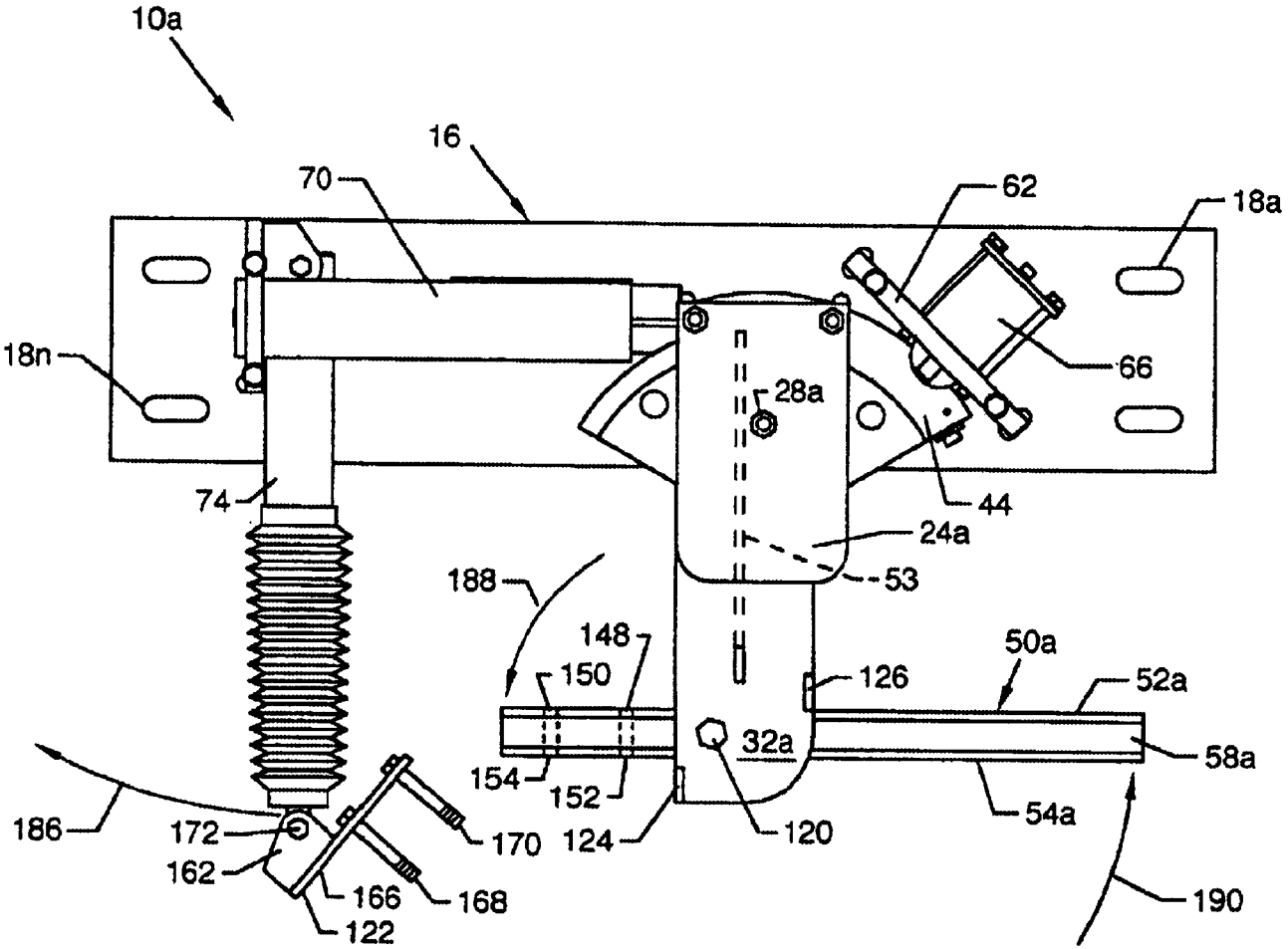

FIG. 14 illustrates a top view of the railroad gate release mechanism 10*a* where the upper bracket 14 is removed for purpose of clarity. FIG. 14 best illustrates the mode of operation with respect to arm 50*a* of the railroad gate release mechanism 10*a*. In order to perform maintenance on a crossing arm which attaches to the arm 50*a* and to position the arm 50*a* to a position which does not interfere with vehicular grade traffic, the detachable bracket 122 is removed from intimate contact with the tabbed brace plate 53 by removing nuts 182 and 184 from the machine screws 168 and 170, respectively. The machine screws 168 and 170 can then be disengaged from the arm 50*a*, whereby the shock absorber 74 and the detachable bracket 122 can be swung in the direction indicated by arrow 186. The arm 50*a* is then free to pivot about the arm pivot pin 120 in the direction indicated by arrows 188 and 190, thus positioning the crossing arm for maintenance. Stop bars 124 and 126 limit rotation of the arm 50*a*.

Various modifications can be made to the present invention without departing from the apparent scope hereof.

RAILROAD GATE RELEASE MECHANISM PARTS LIST

| | |
|---|---|
| 10 | railroad gate release mechanism |
| 10a | railroad gate release mechanism |
| 12 | crossing arm |
| 14 | upper bracket |
| 16 | lower bracket |
| 18a–n | mounting holes |
| 20 | mount arm |
| 22 | mount arm |
| 24 | upper bearing plate |

-continued

| | |
|---|---|
| 24a | upper bearing plate |
| 26 | lower bearing plate |
| 26a | lower bearing plate |
| 28 | pivot pin |
| 28a | pivot pin |
| 30 | pivotable arm assembly |
| 30a | pivotable arm assembly |
| 32 | upper swing plate |
| 32a | upper swing plate |
| 34 | lower swing plate |
| 34a | lower swing plate |
| 36 | cable guide plate |
| 38 | cable guide plate |
| 40 | cable channel |
| 42 | detent |
| 44 | cable guide plate |
| 46 | cable guide plate |
| 48 | cable channel |
| 49 | tabbed brace plate |
| 50 | arm |
| 50a | arm |
| 51 | tabbed brace plate |
| 52 | right arm plate |
| 52a | right arm plate |
| 53 | tabbed brace plate |
| 54 | left arm plate |
| 54a | left arm plate |
| 56 | spacer bar |
| 56a | spacer bar |
| 58 | spacer bar |
| 58a | spacer bar |
| 62 | right brace plate |
| 64 | left brace plate |
| 65 | rectangular hole |
| 66 | plunger housing |
| 68 | plunger |
| 70 | upper spring assembly |
| 72 | lower spring assembly |
| 74 | shock absorber |
| 76 | centering spring assembly |
| 78 | mounting bracket |
| 80 | mounting bracket |
| 82 | slot |
| 84 | slot |
| 86 | bore |
| 88 | bore |
| 90 | cable |
| 92 | cable |
| 94 | ball end |
| 96 | ball end |
| 98 | circular plate |
| 100 | circular plate |
| 102 | spring |
| 104 | spring |
| 106 | end |
| 108 | end |
| 110 | arrow |
| 112 | mounting bracket set |
| 114 | mounting bracket set |
| 116 | arrow |
| 120 | arm pivot pin |
| 122 | detachable bracket |
| 124 | stop bar |
| 126 | stop bar |
| 128 | bracing plate |
| 130 | bracing plate |
| 132 | body hole |
| 134 | body hole |
| 136 | hole |
| 138 | hole |
| 140 | washer |
| 142 | nut |
| 144 | pivot hole |

-continued

| | |
|---|---|
| 146 | pivot hole |
| 148 | body hole |
| 150 | body hole |
| 152 | body hole |
| 154 | body hole |
| 156 | support bar |
| 162 | holed plate |
| 164 | holed plate |
| 166 | holed base plate |
| 168 | machine screw |
| 170 | machine screw |
| 172 | machine screw |
| 174 | washer |
| 176 | nut |
| 178 | washer |
| 180 | washer |
| 182 | nut |
| 184 | nut |
| 186 | arrow |
| 188 | arrow |
| 190 | arrow |

What is claimed is:

1. For use with a gate having a horizontally extending barrier arm and an actuator for raising the barrier arm to allow passage through the gate, a release mechanism for attachment between the barrier arm and the actuator and operable when the barrier arm is impacted to allow the barrier arm to swing horizontally and thereby withstand the impact without breaking, the release mechanism comprising:

a. opposing, spaced apart brackets for attachment to the actuator;

b. a pivotable arm assembly, said pivotable arm assembly comprising an elongated arm having a rearward end and a forward end and a pair of swing plates each having a rearward end and a forward end, said pair of swing plates being held in spaced apart relationship with respect to each other by a brace extending therebetween, said rearward end of said elongated arm extending between said pair of swing plates and being removably attached to said brace, said forward end of said elongated arm extending forwardly beyond said forward ends of said pair of swing plates and having a portion to which the barrier arm is attachable, and a first divot pin passing through said pair of swing plates and pivotally attaching said pair of swing plates and attached elongated arm to said brackets; and, c. a second pivot pin extending through said pair of swing plates and through said elongated arm, said elongated arm being pivotable about said second pivot pin to a maintenance position in which said elongated arm extends perpendicular to said pair of swing plates and parallel to said brackets when said rearward end of said elongated arm is detached from said brace.

2. The release mechanism as defined in claim 1, and further including a pair of stop bars extending between said pair of swing plates for limiting pivotal movement of said elongated arm about said second pivot pin.

3. For use with a gate having a horizontally extending barrier arm and an actuator for raising the barrier arm to allow passage through the gate, a release mechanism for attachment between the barrier arm and the actuator and operable when the barrier arm is impacted to allow the barrier arm to swing horizontally and thereby withstand the impact without breaking, the release mechanism comprising:

a. opposing, spaced apart brackets for attachment to the actuator;

b. a pivotable arm assembly, said pivotable arm assembly comprising an elongated arm having a rearward end and a forward end and a pair of swing plates each having a rearward end and a forward end, said pair of swing plates being held in spaced apart relationship with respect to each other by a brace extending therebetween, said rearward end of said elongated arm extending between said pair of swing plates and being removably attached to said brace, said forward end of said elongated arm extending forwardly beyond said forward ends of said pair of swing plates and having a portion to which the barrier arm is attachable, and a first pivot pin passing through said pair of swing plates and pivotally attaching said pair of swing plates and attached elongated arm to said brackets;

c. a detent incorporated with the rearward end of one of said pair of swing plates;

d. a spring-loaded plunger engageable with said detent, said detent and said spring-loaded plunger being oriented such that when said spring-loaded plunger is engaged with said detent, said pivotable arm assembly is held in a perpendicular relationship with respect to said brackets, said spring-loaded plunger being releasable from said detent upon an impacting force being exerted on said forward end of said elongated arm to allow said pivotable arm assembly to pivot from said perpendicular relationship with respect to said brackets; and, e. a second pivot pin extending through said pair of swing plates and through said elongated arm, said elongated arm being pivotable about said second pivot pin to a maintenance position in which said elongated arm extends perpendicular to said pair of swing plates and parallel to said brackets when said rearward end of said elongated arm is detached from said brace.

4. The release mechanism as defined in claim 3, further comprising means for returning said pivotable arm assembly to said perpendicular relationship with respect to said brackets with said spring-loaded plunger engaging said detent when said impacting force is no longer applied.

5. The release mechanism as defined in claim 4, wherein said means for returning said pivotable arm assembly to said perpendicular relationship with respect to said brackets includes a spring assembly.

6. The release mechanism as defined in claim 5, wherein one of said pair of swing plates has an arcuate edge at said rearward end thereof, and wherein said spring assembly includes a spring and a cable which is connected with said spring, said cable extending from said spring along said arcuate edge of said one swing plate to an end thereof anchored to said one swing plate.

7. The release mechanism as defined in claim 5, wherein said means for returning said pivotable arm assembly to said perpendicular relationship with respect to said brackets further includes a shock absorber.

8. The release mechanism as defined in claim 3, and further including a pair of stop bars extending between said pair of swing plates for limiting pivotal movement of said elongated arm about said second pivot pin.

9. A gate comprising:

a. a horizontally extending barrier arm;

b. an actuator for raising said horizontally extending barrier arm; and, c. a release mechanism located between and coupled to said barrier arm and said actuator and operable when said barrier arm is impacted to allow said barrier arm to swing horizontally and thereby withstand the impact without breaking, said release mechanism comprising:

(1) opposing, spaced apart brackets attached to said actuator;

(2) a pivotable arm assembly, said pivotable arm assembly comprising an elongated arm having a rearward end and a forward end and a pair of swing plates each having a rearward end and a forward end, said pair of swing plates being held in spaced apart relationship with respect to each other by a brace extending therebetween, said rearward end of said elongated arm extending between said pair of swing plates and being removably attached to said brace, said forward end of said elongated arm extending forwardly beyond said forward ends of said pair of swing plates and having a portion to which said barrier arm is attached, and a first pivot pin passing through said pair of swing plates and pivotally attaching said pair of swing plates and attached elongated arm and barrier arm to said brackets attached to said actuator;

(3) a detent incorporated with the rearward end of one of said pair of swing plates;

(4) a spring-loaded plunger engageable with said detent, said detent and said spring-loaded plunger being oriented such that when said spring-loaded plunger is engaged with said detent, said pivotable arm assembly and attached barrier arm are held in a perpendicular relationship with respect to said brackets, said spring-loaded plunger being releasable from said detent upon an impacting force being exerted on said barrier arm to allow said pivotable arm assembly and attached barrier arm to pivot from said perpendicular relationship with respect to said brackets; and, (5) a second pivot pin extending through said pair of swing plates and through said elongated arm, said elongated arm being pivotable about said second pivot pin to a maintenance position in which said elongated arm and attached barrier arm extend perpendicular to said pair of swing plates and parallel to said brackets when said rearward end of said elongated arm is detached from said brace.

10. The gate as defined in claim 9, further comprising means for returning said pivotable arm assembly and barrier arm to said perpendicular relationship with respect to said brackets with said spring-loaded plunger engaging said detent when said impacting force is no longer applied.

11. The gate as defined in claim 9, and further including a pair of stop bars extending between said pair of swing plates for limiting pivotal movement of said elongated arm about said second pivot pin.

* * * * *